US005533075A

United States Patent [19]

Jones et al.

[11] Patent Number: 5,533,075

[45] Date of Patent: Jul. 2, 1996

[54] SPENT FUEL CONTAINER ALIGNMENT DEVICE AND METHOD

[75] Inventors: Stewart D. Jones, Mechanicville; George V. Chapek, Scotia, both of N.Y.

[73] Assignee: The United States of America as represented by the United States Department of Energy, Washington, D.C.

[21] Appl. No.: 473,460

[22] Filed: Jun. 7, 1995

[51] Int. Cl.[6] ..... G21F 5/008

[52] U.S. Cl. ..... 376/272; 376/248; 376/258

[58] Field of Search ..... 376/248, 258, 376/260, 261, 272, 452; 250/506.1, 507.1; 220/507; 206/459.5

[56] References Cited

U.S. PATENT DOCUMENTS 4,149,087 4/1979 Artemiev et al. ..... 376/272

4,242,178 12/1980 Batjukov et al. ..... 376/272

5,241,572 8/1993 Matthews ..... 376/272

5,430,778 7/1995 Yaginuma ..... 376/258

*Primary Examiner*—Daniel D. Wasil

*Attorney, Agent, or Firm*—Virginia B. Caress; William R. Moser; Paul A. Gottlieb

[57] ABSTRACT

An alignment device is used with a spent fuel shipping container including a plurality of fuel pockets for spent fuel arranged in an annular array and having a rotatable cover including an access opening therein. The alignment device includes a lightweight plate which is installed over the access opening of the cover. A laser device is mounted on the plate so as to emit a laser beam through a laser admittance window in the cover into the container in the direction of a pre-established target associated with a particular fuel pocket. An indexing arrangement on the container provides an indication of the angular position of the rotatable cover when the laser beam produced by the laser is brought into alignment with the target of the associated fuel pocket.

17 Claims, 2 Drawing Sheets

SPENT FUEL CONTAINER ALIGNMENT DEVICE AND METHOD

BACKGROUND OF THE INVENTION

1. Field of the Invention

The present invention relates to spent fuel shipping containers for nuclear fuel removed from a reactor and, more particularly, to device and method loading such containers with spent fuel.

2. The Prior Art

A spent fuel shipping container is a large steel cylinder or drum, typically 8 ft. in diameter and 15 ft. in height, and weighing 300,000 lbs. The container is used for the shipment of multiple pieces of spent nuclear fuel. Referring to FIG. 1, a representative container, which is generally denoted 10, includes a top or lid 12 that can be rotated on a bearing (not shown) such that an access opening 14 in the top of the container, i.e., in the cover 12, can be rotated to a position wherein the opening 14 is positioned precisely over the center of one of a plurality of fuel pockets 16 provided within container 10. Thus, spent fuel is inserted through access opening 14 into container 10 and thence into the selected fuel pocket 16. An index ring (not shown in FIG. 1), graduated in degrees, is affixed to the top 12 of the container 10 so that the correct indexed location of the access opening 14 over each of the respective pockets 16 can be identified for recording.

Prior to placing fuel inside the container 10, the precise index location of each pocket 16 is determined by the use of a mechanical alignment device (not shown). Typically, this alignment device is shaped like a cylindrical "plug" with a rod extending vertically upwardly through the top of the plug. The plug is inserted through the access opening 14 of the cover 12 into the corresponding container pocket 16. The diameter of the plug is such that the plug forms what is effectively a piston—cylinder fit with the pocket 16. Once the plug is installed, the rod associated with the plug, which extends upwardly above the top of container 10, is used, along with suitable mechanical adapters, to establish that the center of the access opening 14 is precisely aligned with the center of the corresponding fuel pocket 16. The reading of the index ring (in degrees of rotation) is then recorded and this reading is used subsequently to align the opening 14 in the cover 12 in the appropriate position above each of the other fuel pockets 16 as fuel is put into the container.

It will be appreciated that the mechanical alignment device described above suffers a number of disadvantages and limitations. Some disadvantages of the prior art mechanical device and the method of using the same include those resulting from the fact that the mechanical device must be installed into, and in contact with, the "internals" of the spent fuel container which are highly radioactively contaminated. Thus, during the alignment operation, the radioactive contamination is transferred to the alignment device itself. After alignment of each fuel pocket, the alignment device is removed and must be partially decontaminated prior to the installation thereof into the next pocket. After the completion of all alignments, the device is completely decontaminated for subsequent packaging and storage until the next container is prepared for use. It will be appreciated that this radioactive decontamination presents a risk to operators due to the high levels of contamination normally encountered.

Considering other limitations and disadvantages thereof, the mechanical alignment device must be installed into and subsequently removed from, each pocket being aligned.

Further, the device requires the repeated use of containments in order to be able to operate the device in a radioactive environment, i.e., so as to separate the operator from the contamination within in the container. Moreover, the required decontamination of the mechanical device subjects operating personnel to radiation exposure.

Historically, the time required to accomplish the alignment of each fuel pocket using the prior art mechanical device ranges from two to eight hours. Moreover, significant amount of time and resources are devoted to preparation of the mechanical device for use, including the performance of load testing and non-destructive testing of lifting attachments. Further, the mechanical device requires the use of an auxiliary crane for installation and removal and the device itself is inherently large and awkward to handle.

SUMMARY OF THE INVENTION

In accordance with the invention, an alignment device for a spent fuel container is provided which significantly reduces the effect of or totally eliminates, each of the disadvantages of the prior art mechanical device discussed above. The alignment device of the invention includes a laser device which is affixed to a lightweight support plate that is installed over the access opening of the cover or lid of the spent fuel container. A pre-established mark on the periphery of, or otherwise associated with, each pocket acts as a laser target. When the device is installed, the container cover is rotated over each pocket and when aligned with the laser target, the rotational position of the cover, and hence of the access opening therein, is observed and recorded.

Briefly considering some of the important advantages of the invention, the laser device of the invention is not installed into or in contact with the internals of the spent fuel container. As a consequence, there is little chance that the high levels of contamination contained within the container will be transferred to the device. Therefore, the risks associated with such transferred contamination are essentially eliminated. Further, the laser device is not installed into each pocket. As will be described, the device is installed once, on top of the container, and remains there until all pockets have been aligned. In addition, the laser device does not require the repeated use of containments, because the device itself acts as a contaminant barrier. The radiation exposure encountered during decontamination of the prior art mechanical device is virtually eliminated.

Other advantages include a substantial reduction in the alignment time required. It is estimated that the two to eight hour alignment time referred to above which is required in using the prior art mechanical device will be reduced to about 10 minutes with the laser device of the invention, thereby resulting in substantial cost savings. Further, no load testing or non-destructive testing of the laser device is required, no crane is necessary and the laser device can be installed manually. The laser device is significantly less expensive than its prior art mechanical counterpart, considering manufacturing and operating costs. Moreover, the laser device provides more accurate alignment, is less likely to develop time-consuming repair problems, and is self-contained.

In accordance with a preferred embodiment of a first aspect of the invention, an alignment device is provided for use with a spent fuel shipping container including a plurality of fuel pockets for spent fuel arranged in an annular array and having a rotatable cover including an access opening therein, the alignment device comprising: a plate for installation over the access opening in the container and including a laser admittance window therein; a laser device mounted on the plate for directing a laser beam through the laser admittance window into the container; and indexing means on the container for providing an indication of the angular position of the rotatable cover when the laser beam produced by the laser is brought into alignment with a fuel pocket in the container.

In one embodiment, the plate further comprises a viewing window therein for enabling viewing of the laser beam within the container. In another embodiment, the laser admittance window is sized so as to permit viewing of the laser beam within the container.

Preferably the device further comprises fixing means for fixing the orientation of the plate, and the laser mounted thereon, on the cover of the container. In one embodiment, the fixing means comprises a pair of pin members on the plate and a corresponding pair of pin openings formed in the cover. In another embodiment, the fixing means comprises a pair of pin members on the cover and a corresponding pair of pin openings formed in the plate.

The plate further advantageously comprises at least one handle for facilitating installation and removal of the plate.

Preferably, the device further comprises sealing means for providing a seal between the plate and the cover of the container. Advantageously, the plate is circular in shape and the sealing means comprises a sealing O-ring disposed around the periphery of the plate.

The laser device preferably comprises a low power laser and a laser mount comprising a cage in which the laser is supported and a bracket securing the cage to the plate.

In accordance with a preferred embodiment of the invention, a method is provided for determining the alignment position of an access opening of a cover for a spent fuel container with respect to each of a plurality of annularly arranged fuel pockets within the spent fuel container so that spent fuel can be placed into each of said fuel pockets through the access opening, the method comprising: pre-establishing an alignment target for each of the fuel pockets; mounting a support plate including a laser admittance window therein over the access opening of the cover of the spent fuel container; affixing a laser to the support plate in alignment with said laser admittance window in an orientation wherein, when the laser is energized, laser beam is directed into the container through the window; energizing the laser and rotating the cover until the laser beam directed by the laser into said container is in alignment with the target of a first fuel pocket; using an index ring arrangement at the top of the container to determine the angular position of the cover, and hence the relative angular alignment position of the first fuel pocket, when the laser beam is in alignment with the target of the first fuel pocket; and repeating the process for each of the other fuel pockets.

Preferably each of the targets is established by providing a target groove at the site of the respective fuel pocket which produces enhanced reflection of a laser beam in alignment with the groove. Advantageously, the groove is provided on a slanted shoulder at the top of the fuel pocket.

The method preferably further comprises viewing the laser beam within the container so as to determine when the laser beam is in alignment with the target. Affixing of the laser to the support plate preferably comprises mounting the laser in a fixture (mount) on the plate.

The support plate is preferably mounted on said cover in a predetermined orientation determined by a mounting assembly for the plate. The mounting assembly advantageously comprises a pair of pin members and a corresponding pair of openings for receiving the pin members.

Other features and advantages of the invention will be set forth in, or apparent from, the following detailed description of preferred embodiments of the invention.

BRIEF DESCRIPTION OF THE PREFERRED EMBODIMENT

Figure 1:
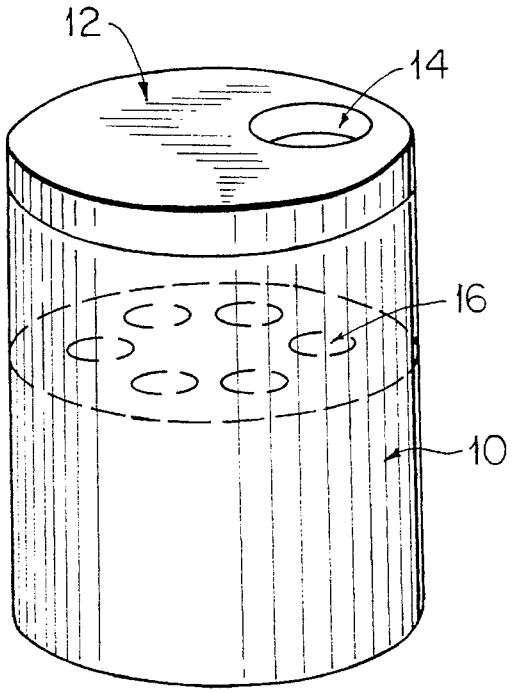
FIG. 1 PRIOR ART
FIG. 1, which was described above, is a perspective view of a spent fuel container of the type to which the invention is applicable.
Figure 2:
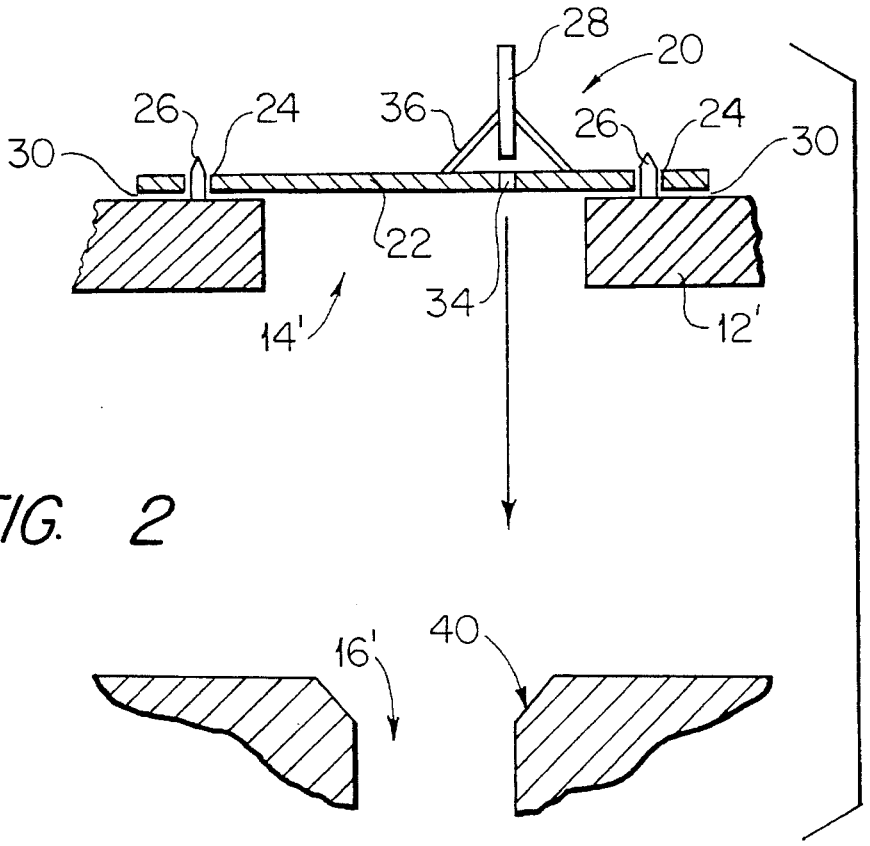
FIG. 2 is a cross sectional view, partially broken away, of a first embodiment of the laser alignment device of the invention as mounted on a spent fuel container.
Figure 3:
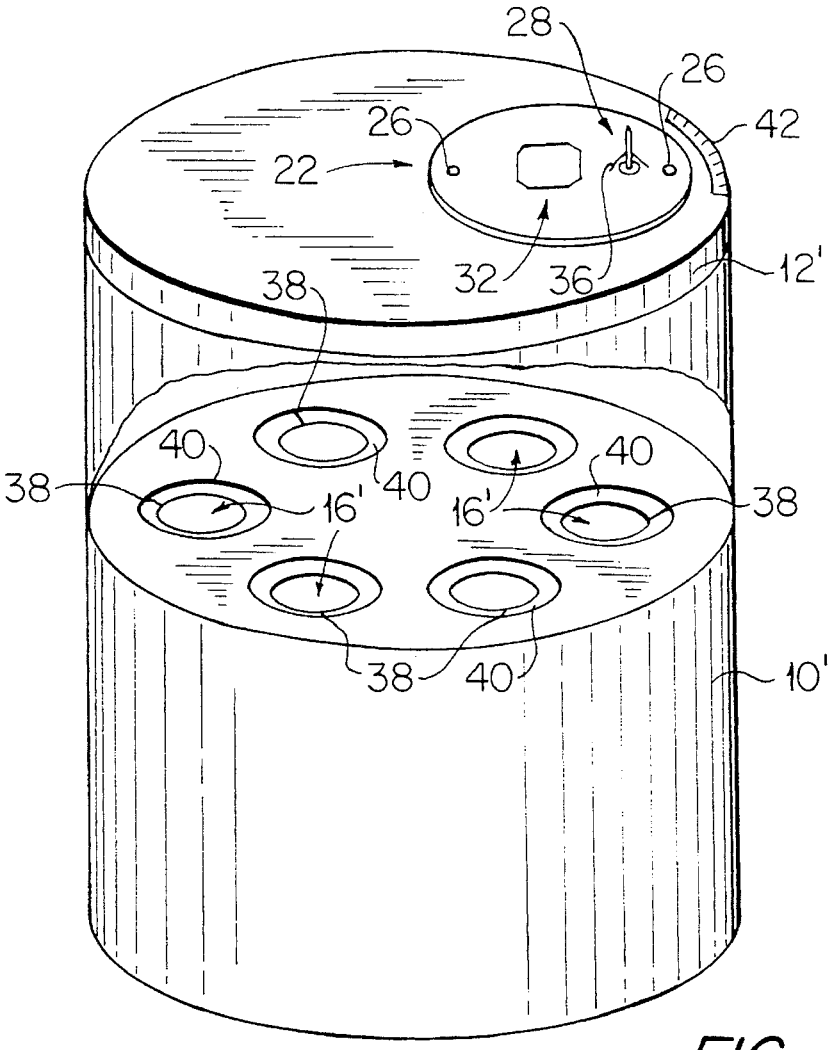
FIG. 3 is a perspective view of a spent fuel container with the alignment device of the invention mounted thereof.

Referring to FIGS. 2 and 3, a preferred embodiment of the alignment device of the invention is illustrated. FIGS. 2 and 3 also show a spent fuel container which basically corresponds to that discussed above in connection with FIG. 1 and elements of which are identified by the same reference numerals in FIGS. 2 and 3 with primes attached. The alignment device, which is generally denoted 20, includes a lightweight plate 22 which is fitted over the access opening 14' in the cover or lid 12' of the container 10'. Plate 22 is supported on cover 12' by a mounting arrangement including a plurality of pin holes 24 formed in plate 22 and a plurality of pins 26 disposed on the upper surface of cover 12'. It will be appreciated that the pins can be provided on plate 22 and the pinholes provided in cover 12' (as described below in connection with FIG. 4) and that other mounting arrangements can also be used.

Plate 22 acts as a foundation or support for the installation and use of a laser 28. Thus, the main purpose of the mounting arrangement, i.e., the pins and pinholes of the exemplary embodiment being discussed, is to orient the laser 28 with respect to the centerline of the access opening 14' of the cover 12' of the spent fuel shipping container 10'. An O-ring 30 is installed on the underside of plate 22 around the periphery thereof. The plate 22 includes a viewing window 32 (not shown in FIG. 2) which enables visual observation of the laser beam for targeting purposes and a laser aperture or laser admittance window 34 (best seen in FIG. 2) disposed beneath laser 28 and through which the laser beam is transmitted. Plate 22 also preferably includes a pair of opposed handles (not shown) for permitting manual installation and removal thereof.

Laser 28 preferably comprises a low power (approximately 0.5 mw) helium neon (HeNe) laser or visible diode laser. Such lasers are commercially available, self-contained and powered from batteries or a small 115 V a.c. adapter. An example of a suitable helium neon laser is that made by Melles Griot of Irvine, Calif. identified as Model 05 LLR 881 while an example of a suitable visible diode laser is the Model No. 06 DAL 001 (and 06 DAL 001/A) produced by the same manufacturer. A snap-in mount (not shown) is available as an accessory to enable fixed mounting of the laser device 28. The snap-in mount is attached to plate 22 with suitable fasteners (not shown). The mount for the laser 28 is shown schematically in the drawings and is generally denoted 36 in FIGS. 2 and 3. It is noted that a suitable mount is described in more detail in connection with FIG. 4.

A suitable laser target 38 is incorporated into the top surface of each of the fuel pockets 16' of the spent fuel shipping container 10' during the container assembly process. The targets 38 are preferably reflective grooves or strips which provide enhanced reflection of the incoming beam. In the exemplary embodiment illustrated in FIGS. 2 and 3, the targets 38 are provided on the slanted shoulders 40 (FIG. 2) of the pockets 16'. A conventional indexing ring arrangement, represented by ring 42 (FIG. 3), is provided on the top of container 10' to indicate the proper angular position of cover 12' as is described in more detail below.

In operation, prior to use of the system of the invention, the operability of the laser 28 is checked, as is the condition of the O-ring 30 on the bottom of plate 22. The laser 28 is mounted into the mount (indicated schematically at 36) and the perpendicularity of the laser 28 to the plate 22 is confirmed. A closure plug (not shown) is removed from the access opening 14' of the cover or lid 12' and the laser 28 is installed over the opening 14' and energized. The cover 12' of container 10' is then rotated and the laser beam is viewed through the viewing window 32 (see FIG. 3). Proper indexing is indicated when the reflection of the laser beam brightens because of the enhanced reflection provided by the target groove 28. The index ring arrangement 42 (FIG. 3) at the top of the container 10' permits identification of the azimuth reading which corresponds to the fuel pocket in question.

Figure 4:
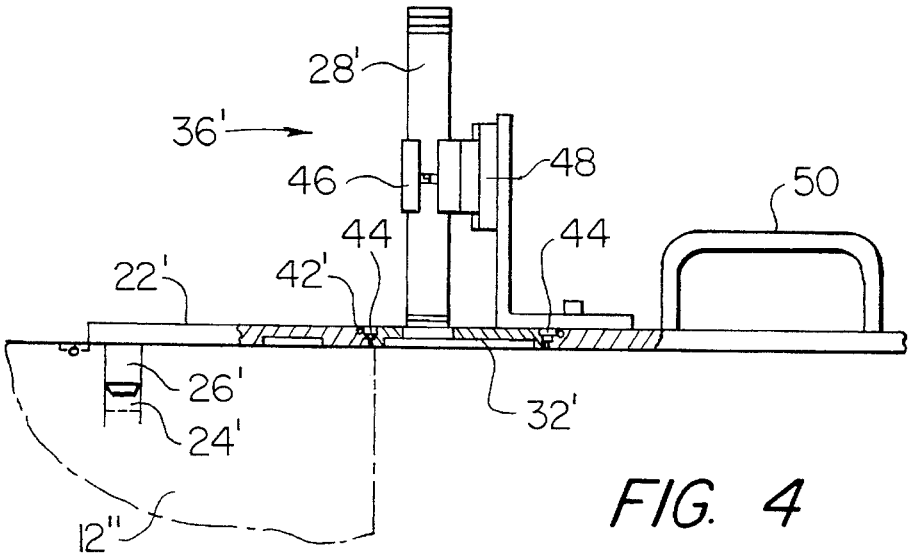
FIG. 4 is a cross sectional view, partially broken away, of a further embodiment of the alignment device of the invention, with a portion of a spent fuel container shown in phantom lines.

Referring to FIG. 4, a further embodiment of the invention is shown. In FIG. 4, the cover is denoted 12" while elements similar to those of FIGS. 2 and 3 are given the same reference numerals with primes attached. In general, FIG. 4 simply illustrates some of the elements of FIGS. 2 and 3 in more detail, although there are also some differences. In FIG. 4, the support plate 22' is provided with pins or dowels (one of which, denoted 26', is shown) while the cover 12" includes the corresponding pinholes or recesses (one of which, denoted 24', is shown). More importantly, in accordance with this preferred embodiment, a single access window, denoted 32' is employed which provides both a laser mount and viewing access. As illustrated, window 32' is mounted in a recess 42' in plate 22' and secured to plate 22' by capscrews 44. Laser 28' is mounted by a mounting arrangement generally denoted 36' and including a support cage 46 and an L-shaped mounting bracket 48 secured to plate 22'. FIG. 4 also illustrates one of two gripping handles, denoted 50, which were mentioned above and which are located on opposite sides of plate 22'. It will be appreciated that the operation of the embodiment of FIG. 4 is basically the same as that of the embodiment of FIGS. 2 and 3.

Although the present invention has been described relative to specific exemplary embodiments thereof, it will be understood by those skilled in the art that variations and modifications can be effected in these exemplary embodiments without departing from the scope and spirit of the invention.

What is claimed is:

1. An alignment device for use with a spent fuel shipping container including a plurality of fuel pockets for spent fuel arranged in an annular array and having a rotatable cover including an access opening therein, said alignment device comprising:

a plate for installation over the access opening of the cover and including a laser admittance window therein;

a laser device mounted on said plate for directing a laser beam through said laser admittance window into said container; and indexing means provided on said container for providing an indication of the angular position of the rotatable cover when the laser beam produced by the laser is brought into alignment with a fuel pocket in the container.

2. A device as claimed in claim 1 wherein said plate further comprises a viewing window therein for enabling viewing of the laser beam within the container.

3. A device as claimed in claim 1 wherein said laser admittance window is sized so as to permit viewing of the laser beam within the container.

4. A device as claimed in claim 1 further comprising fixing means for fixing the orientation of the plate, and the laser mounted thereon, on the cover of the container.

5. A device as claimed in claim 4 wherein said fixing means comprises a pair of pin members on the plate and a corresponding pair of pin openings formed in the cover.

6. A device as claimed in claim 4 wherein said fixing means comprises a pair of pin members on the cover and a corresponding pair of pin openings formed in the plate.

7. A device as claimed in claim 1 wherein said plate further comprises at least one handle for facilitating installation and removal of the plate.

8. A device as claimed in claim 1 further comprising sealing means for providing a seal between said plate and the cover of the container.

9. A device as claimed in claim 8 wherein said plate is circular in shape and said sealing means comprises a sealing O-ring disposed around the periphery of the plate.

10. A device as claimed in claim 1 wherein said laser device comprises a low power laser and a laser mount comprising a cage in which the laser is supported and a bracket securing the cage to the plate.

11. A method for determining the alignment position of an access opening of a cover for a spent fuel container with respect to each of a plurality of annularly arranged fuel pockets within the spent fuel container so that spent fuel can be placed into each of said fuel pockets through said access opening, said method comprising:

preestablishing an alignment target for each of the fuel pockets;

mounting a support plate including a laser admittance window therein over the access opening of the cover of the spent fuel container;

affixing a laser to said support plate in alignment with said laser admittance window in an orientation wherein, when the laser is energized, a laser beam is directed into said container through the window;

energizing the laser and rotating the cover until the laser beam directed by the laser into said container is in alignment with the target of a first fuel pocket;

using an index ring arrangement at the top of the container to determine the angular position of the cover, and hence the relative angular alignment position of the first fuel pocket, when the laser beam is in alignment with the target of the first fuel pocket; and repeating the process for each of the other fuel pockets.

12. A method as claimed in claim 11 wherein each of said targets is established by providing a target groove at the site of the respective fuel pocket which produces reflection enhancement of a laser beam in alignment with said groove.

13. A method as claimed in claim 12 wherein said groove is provided on a slanted shoulder at the top of the fuel pocket.

14. A method as claimed in claim 11 further comprising viewing the laser beam within said container so as to determine when said laser beam is in alignment with the target.

15. A method as claimed in claim 11 wherein affixing of said laser to the support plate comprises mounting the laser in a fixture on said plate.

16. A method as claimed in claim 11 wherein said support plate is mounted on said cover in a predetermined orientation determined by a mounting assembly for said plate.

17. A method as claimed in claim 16 wherein said mounting assembly comprises a pair of pin members and a corresponding pair of openings for receiving the pin members.

* * * * *